US005174253A

United States Patent [19]

Yamazaki et al.

[11] Patent Number: 5,174,253

[45] Date of Patent: Dec. 29, 1992

[54] APPARATUS FOR SHIFTING PHASE BETWEEN SHAFTS IN INTERNAL COMBUSTION ENGINE

[75] Inventors: Masami Yamazaki, Okazaki; Yukiharu Ichinose; Atsushi Watanabe, both of Toyota, all of Japan

[73] Assignee: Toyota Jidosha Kabushiki Kaisha, Toyota, Japan

[21] Appl. No.: 806,762

[22] Filed: Dec. 13, 1991

[30] Foreign Application Priority Data

Jan. 11. 1991 [JP] Japan ..... 3-002319

[51] Int. Cl.[5] ..... F01L 1/34

[52] U.S. Cl. ..... 123/90.17; 123/90.31

[58] Field of Search ..... 123/90.15, 90.17, 90.31; 464/2, 160

[56] References Cited

U.S. PATENT DOCUMENTS 4,305,352 12/1981 Oshima et al. ..... 123/90.15

FOREIGN PATENT DOCUMENTS 59-156102 10/1984 Japan .
60-153410 8/1985 Japan .
1-14076 9/1989 Japan .

*Primary Examiner*—Tony M. Argenbright
*Assistant Examiner*—Weilun Lo
*Attorney, Agent, or Firm*—Kenyon & Kenyon

[57] ABSTRACT

Disclosed is an apparatus for shifting a phase between shafts in an internal combustion engine. A phase shifting device for shifting a rotational phase of the driven shaft to the drive shaft and an amplifying gear mechanism having a plurality of gears are disposed between the drive shaft and driven shaft. The amplifying gear mechanism amplifies the amount of phase shifting when the phase shifting is made by the phase shifting device and rotates all the gears integrally when no phase shifting is made.

19 Claims, 8 Drawing Sheets

APPARATUS FOR SHIFTING PHASE BETWEEN SHAFTS IN INTERNAL COMBUSTION ENGINE

BACKGROUND OF THE INVENTION

1. Field of the Invention

The present invention relates to an apparatus for shifting the phase between shafts (hereinafter referred to as intershaft phase shifting apparatus). More specifically, this invention pertains to an intershaft phase shifting apparatus for a valve timing control device or the like which shifts the rotational phase of a cam shaft to a crank shaft and varying the amount of the phase shift in order to control the opening/closing timing of intake and exhaust valves in an internal combustion engine in accordance with the running state of the engine.

2. Description of the Related Art

As a phase shifting apparatus of this type, a phase shifting apparatus (cam shaft driving apparatus) using a planetary gear mechanism is disclosed in, for example, Japanese Unexamined Utility Model Publication No. 59-156102. According to this technique, a cam shaft 61 is divided into an input-side shaft 61*a* for driving a crank shaft 62 and an output-side shaft 61*b* having a cam 63 as shown in FIG. 10. A planetary gear mechanism 64 intervenes between these shafts 61*a* and 61*b*. In the planetary gear mechanism 64, a carrier 65 is attached to the end of the input-side shaft 61*a*. On the carrier 65 are rotatably supported a plurality of planetary gears 66 whose outer peripheral portions are engaged with a ring gear 67. A sun gear 68 is attached to the end of the output-side shaft 61*b*, and it is engaged with the inner peripheral portions of the planetary gears 66. The ring gear 67 is rotated by a piston 70 which is thrust forward and backward from a cylinder 69.

According to this apparatus, as the ring gear 67 rotates due to the forward/backward movement of the piston 70, the carrier 65 and sun gear 68 rotate by different angles. This causes the rotational phase of the crank shaft 62 to deviate from that of the output-side shaft 61*b*, thus changing the opening/closing timing of the intake and exhaust valves during engine running. The amount of a phase shift is varied by an amount corresponding to the ratio of the diameter of the sun gear 68 to that of the planetary gears 66.

According to the conventional phase shifting apparatus, however, when no phase shift is performed, the piston 70 will not be activated and the ring gear 67 stays unmoved. It is therefore necessary to always rotate the planetary gears 66 and the sun gear 68. The backlash between those gears 66, 67 and 68 may cause gearing noise or wear out the gears.

SUMMARY OF THE INVENTION

It is therefore an object of the present invention to provide an intershaft phase shifting apparatus capable of preventing individual gears from producing gearing noise or from wearing out or the like when no phase shift between two shafts in an internal combustion engine is performed.

To achieve this object, an intershaft phase shifting apparatus of this invention comprises a drive shaft; a driven shaft; a phase shifting mechanism for shifting a rotational phase of the driven shaft to the drive shaft between the drive shaft and driven shaft; and an amplifying gear mechanism having a plurality of gears, for amplifying an amount of a phase shift when the phase shift is made by the phase shifting mechanism and rotating all the gears integrally when no phase shift is made.

DETAILED DESCRIPTION OF THE PREFERRED EMBODIMENTS

A first preferred embodiment where an intershaft phase shifting apparatus according to the present invention is embodied in a valve timing controller in an internal combustion engine will now be described referring to FIGS. 1 to 5.

Figure 1:
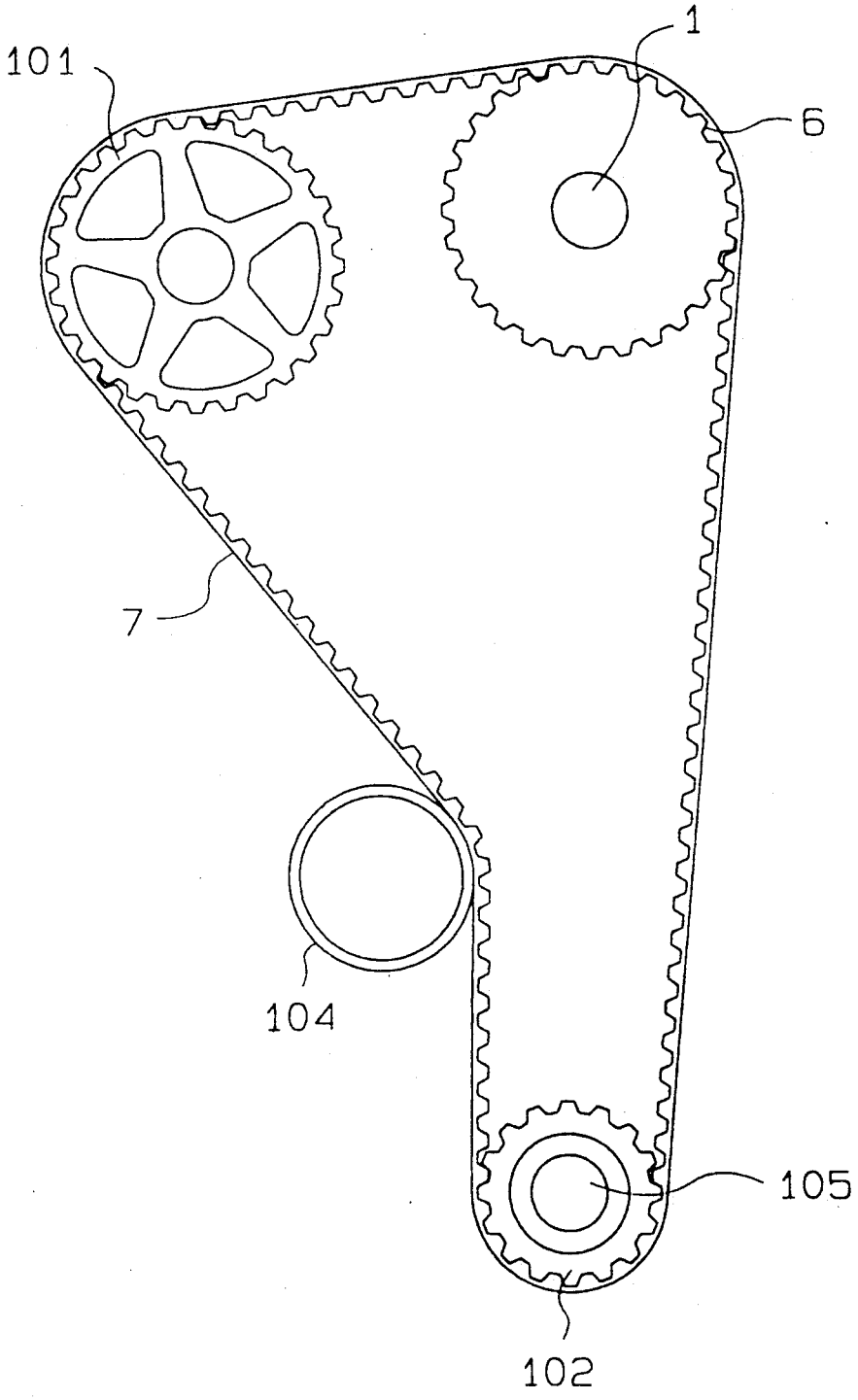
FIG. 1 is a side view of a valve opening/closing mechanism of twin cam shaft type according to a first embodiment of the present invention.

In FIG. 1, the valve timing controller has a timing pulley 6 on the intake side, a timing pulley 101 on the exhaust side, and a timing pulley 102 and a timing belt 7 on the crank shaft side; these components of the controller are coupled to each other by the timing belt 7 to which a tensioner 104 applies a tension. This valve timing controller controls the timing for opening and closing of an intake valve in accordance with the running status of the engine. The valve timing controller therefore is designed to shift the rotational phase of a crank shaft 105 to a cam shaft 1.

Figure 2:
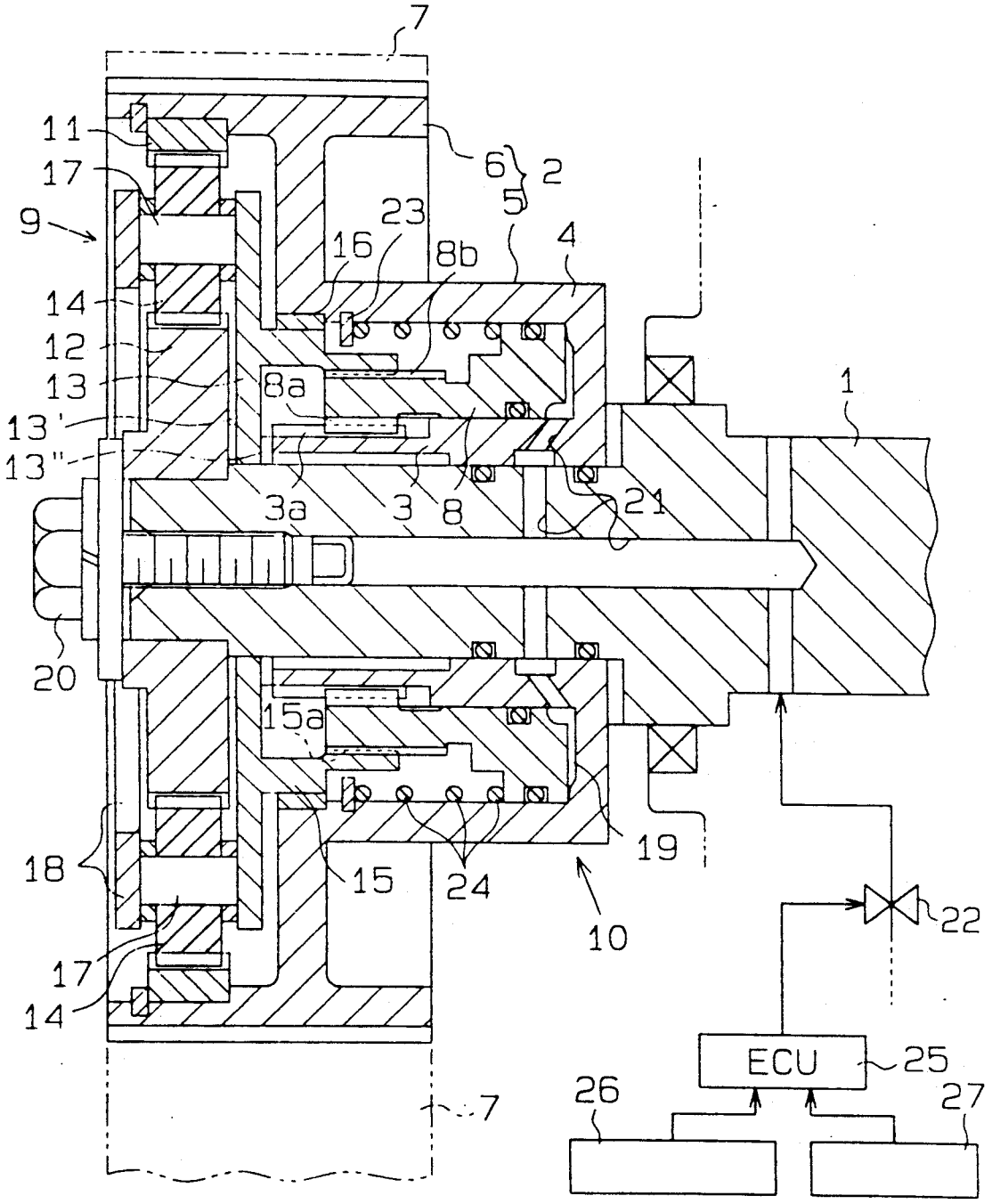
FIG. 2 is a cross section of a valve timing controller when no hydraulic pressure is applied to a piston.

A cylinder 5 is attached to the front end (or the left end) of the cam shaft 1 in FIG. 2. A timing pulley 6 is formed around the outer surface of the front end of the cylinder 5. An annular wall 3 having a small diameter is concentrically provided in the cylinder 5. The cam shaft 1 is fitted in the annular wall 3. As a crank shaft 100 rotates, this movement is transmitted to the cylinder 5 by the timing belt 7.

Between the cam shaft 1 and the cylinder 5 lie a phase shifting mechanism 10 for shifting the rotational phase of the cam shaft 1 to the cylinder 5, and a planetary gear mechanism 9 for amplifying the angle of the rotational phase. The planetary gear mechanism 9 serves as a differential gear mechanism which amplifies the operation of gears.

The planetary gear mechanism 9 includes a ring gear 11, a sun gear 12, a carrier 13 and planetary gears 14. The ring gear 11 is fixed on the inner surface of the front end of the timing pulley 6. The sun gear 12 is secured at the front end of the cam shaft 1 with a volt 20. At the immediately rear end of the sun gear 12, the almost ring-shaped carrier 13 is placed and held between thrust washers 13' and 13", and is fitted rotatable on the outer surface of the cam shaft 1. A cylindrical portion 15 is placed on the rear portion of the carrier 13, and the outer surface of the cylindrical portion 15 touches a bearing 16 on the inner surface of the front end of the cylinder 5. The carrier 13 therefore rotates while sliding in contact with the cam shaft 1, the thrust washers 13' and 13", and the bearing 16.

Three support shafts 17 are protruded from the front outer surface of the carrier 13, and the planetary gears 14 are supported rotatable around the respective support shafts 17. Each planetary gear 14 is engaged with the ring gear 11 and the sun gear 12 to transmit the rotation of the timing pulley 6 to the cam shaft 1. A stopper ring 18 is securely attached to the front end of the support shaft 17 to prevent the planetary gear 14 from falling from the support shaft 17.

The phase shifting mechanism 10 will now be explained. An approximately cylindrical piston 8 is provided in the space defined by the cylinder 5, the annular wall 3 and the carrier 13. Helical splines **8*a* and 8*b* which extend in the opposite directions are formed respectively on the inner and outer surfaces of the front end of the piston 8. The helical splines 8*a* and 8*b* are respectively engaged with the helical spline 3*a* formed on the outer surface of the annular wall 3 and the helical spline 15*a* formed on the inner surface of the cylindrical portion 15 of the carrier 13. Accordingly, the piston 8 is forced to reciprocate while rotating. A pressure chamber 19 is defined between the piston 8 and the inner bottom of the cylinder 5 so that working fluid may be supplied to the pressure chamber 19. More specifically, a fluid path 21 which communicates with the pressure chamber 19 is formed in the cam shaft 1 and the cylinder 5. The working fluid, after sucked by an oil pump (not shown), is controlled by a solenoid-operated hydraulic control valve 22 and is supplied to the pressure chamber 19 through the fluid path 21. The pressure of the supplied working fluid forces the piston 8** to move forward.

An engaging ring 23 is fitted in the inner surface of the front end of the cylinder 5, and a return spring 24 is placed in the space between the engaging ring 23 and the outer surface of the rear end of the piston 8. The engaging ring 23 and the return spring 24 always urge the piston 8 backward.

When the working fluid is not supplied to the pressure chamber 19 (at the advance angle timing), the piston 8 is forced to position at the rear end by the return spring 24 as shown in FIG. 1. When the fluid oil is supplied to the pressure chamber 19, however, the piston 8 is moved rotating forward against the force of the return spring 24. At this time, the helical splines **3*a*, 8*a*, 8*b* and 15*a* shift the rotational phase of the cylinder 5 to the carrier 13, both coupled to the piston 8. In association with this phase shift, the rotational phase of the cam shaft 1 to the crank shaft 105** are also shifted to the delay angle side.

The opening of the control valve 22 is controlled by an electronic control unit (ECU) 25. More specifically, a throttle sensor 26 which detects the opening of the throttle valve 22 is connected as an engine load to the input side of the ECU 25. Further, a rotational speed sensor 27 is connected to the input side of the ECU 25. The sensor 27 detects the number of rotations of the engine in the unit time from the rotations of the rotor of a distributor. The control valve 22 is connected to the output side of the ECU 25.

Figure 5:
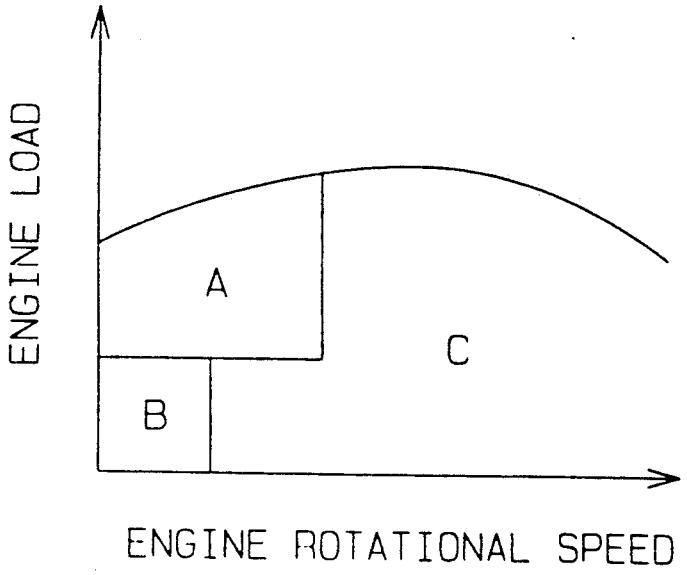
FIG. 5 is a graph showing the relation between the rotational speed of an engine and an engine load.

First to third regions A, B and C as shown in FIG. 5 are previously stored in the ECU 25, indicating the relationship between the engine speed and the engine load. The first region A is selected when the engine is running at a low or middle speed with a high load, the second region B is selected when the engine is running at a low speed with a low load, and the third region C is selected when the engine is running at a middle or high speed regardless of the load. Based on detection signals from the throttle sensor 26 and the rotation speed sensor 27, the ECU 25 determined in which one of the first to third regions A to C the current engine status is, and outputs a control signal for controlling the opening of the hydraulic control valve 22.

The action and effect of the valve timing controller in this embodiment as structured above will now be described.

When the engine starts running, the rotation of the crank shaft 105 is transmitted to the cylinder 5 by the timing belt 7. The ECU 25 receives detection signals from the throttle sensor 26 and the rotation speed sensor 27 to detect the engine load and the engine running speed. The ECU 25 then determines which of the regions A to C the current engine state belongs to. The ECU 25 sends a control signal to the control valve 22 to change the rotational phase of the cam shaft 1 with respect to the crank shaft 105 to a rotational phase corresponding to the determined region A, B or C.

FIG. 2 illustrates the valve timing controller when the ECU 25 has judged that the engine state is in the region A. In this condition, the valve 22 is closed and the working fluid is not supplied to the pressure chamber 19. The piston 8 is therefore forced back by the return spring 24 to stay at the rear end of the cylinder 5.

When the piston 8 stays at the rear end in the cylinder 5 and will not move back and forth, the cam shaft 1, the planetary gear mechanism 9, the piston 8 and the cylinder 5 rotate integrally. This is because the piston 8 is coupled respectively to the annular wall 3 and the carrier 13 while the planetary gears 14 on the carrier 13 mesh with the ring gear 11 and the sun gear 12. A this time, rotational torque which is transmitted to the cylinder 5 by the timing belt 7 is to be sent to the cam shaft 1 via either of the following two routes: a path leading to the cam shaft 1 through the helical splines **8*a* and 8*b*, and the planetary gear mechanism 9, and a path leading to the cam shaft 1 directly through the planetary gear mechanism 9 from the ring gear 11 secured to the timing pulley 6**.

If the piston 8 stays at the rear end of the cylinder 5 as described above, the timing for closing the intake valve is quickened, and a fluid-air mixture fed into an intake cylinder will not easily be returned. This causes the air filling efficiency higher to provide a high output.

Figure 3:
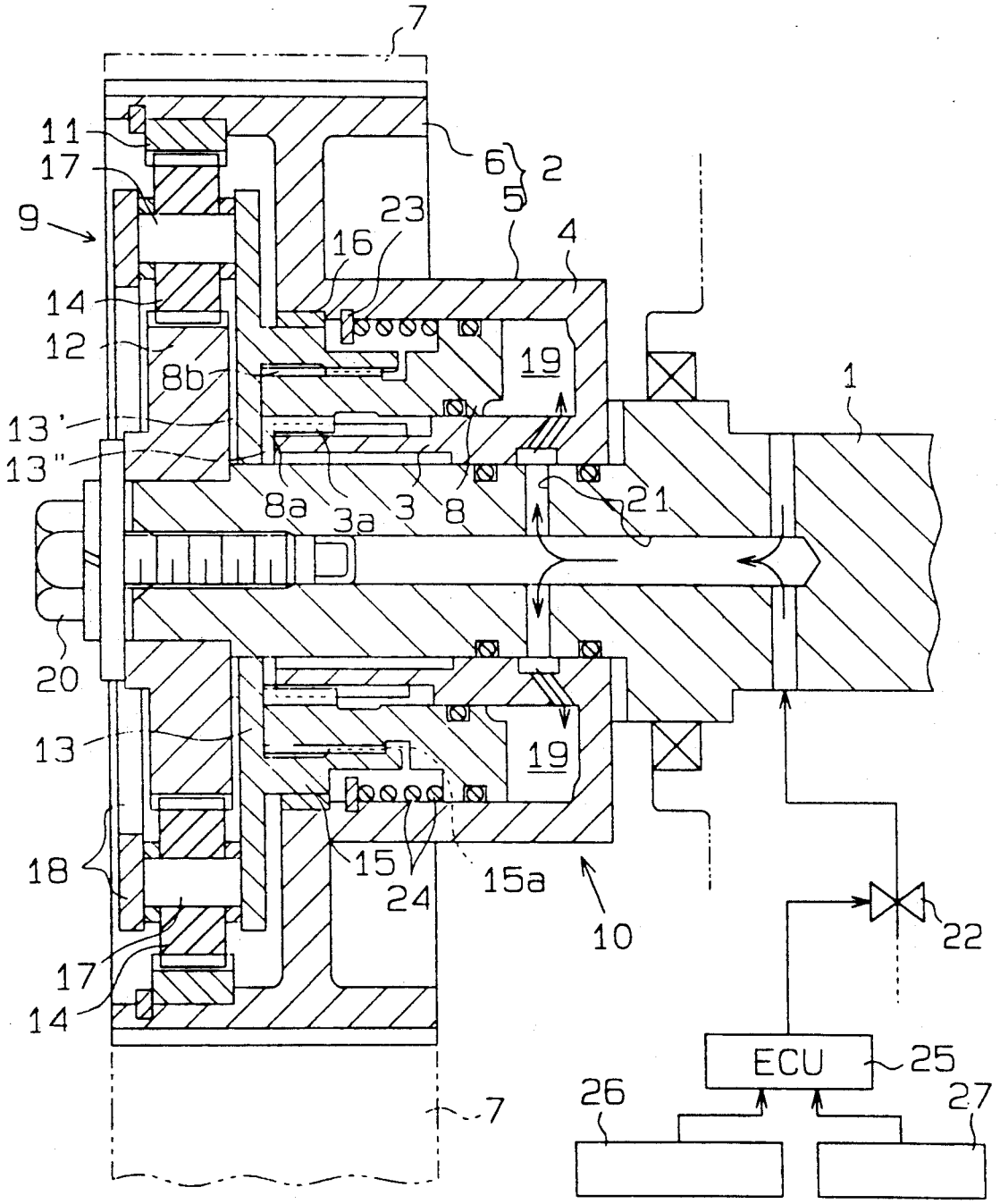
FIG. 3 is a cross section of the valve timing controller when the hydraulic pressure is applied to the piston.

FIG. 3 shows the valve timing controller when the ECU 25 has judged that the state of the engine is changed from the first region A to the second region B. Under these circumstances, the ECU 25 outputs a control signal to open the control valve 22. If the opening of the control valve 22 reaches a predetermined level, the pressure of the working fluid is controlled by the control valve 22, and the working fluid is supplied to the pressure chamber 19 through the fluid path 21. The pressure of the supplied working fluid acts on the rear surface of the piston 8 to push the piston 8 forward against the force of the return spring 24. Then, the piston 8 is moved forward while rotating by the action of the helical splines **3*a*, 8*a*, 8*b* and 15*a*. The movement of the piston 8 applies twisting force to the cylinder 5 and the carrier 13, which rotate separately. The piston 8 stops moving forward when contacting the rear surface of the carrier 13**.

The amount of the shifted rotational phase is increased by the planetary gear mechanism 9. To describe more specifically, the rotational phase of the sun gear 12 to the ring gear 11 can be understood from the following equation.

$$(1+\lambda)Cn = Rn + \lambda \cdot Sn \quad (1)$$

where λ is the ratio of the diameter of the sun gear 12 to that of the ring gear 11, Cn is the number of rotations of the carrier 13, Rn is the number of rotations of the ring gear 11, and Sn is the number of rotations of the sun gear 12.

Figure 4:
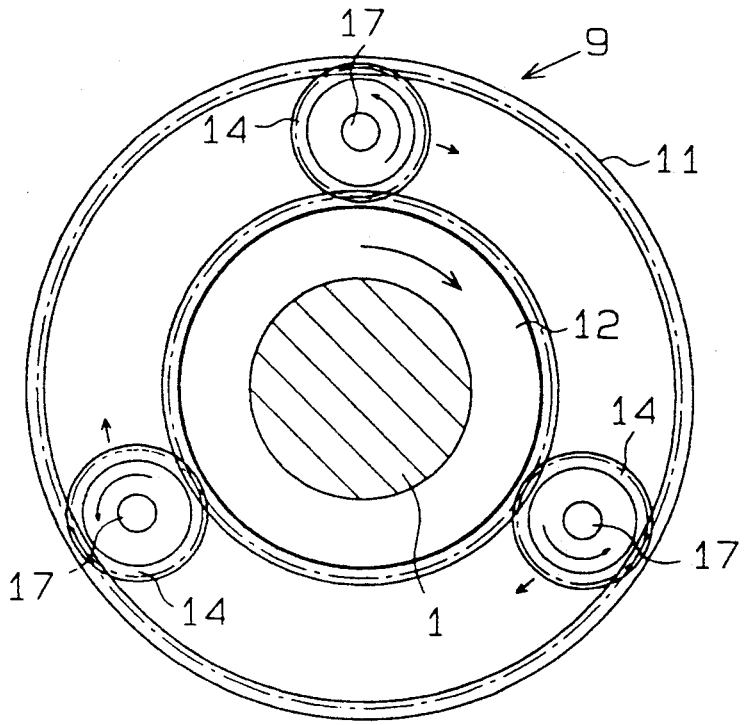
FIG. 4 is a diagram illustrating positional relations between gears in a planetary gear mechanism according to this embodiment.

To simplify the explanation, it is assumed that the ring gear 11 is fixed, and the rotational force of the crank shaft is received by the carrier 13 and is output from the sun gear 12, as shown in FIGS. 3 and 4. This assumption is made because, with the ring gear 11 fixed so, the phase difference between the ring gear 11 and the carrier 13 can be considered in terms of the rotation of the carrier 13.

Because the ring gear 11 is fixed as mentioned above, Rn=0, Substituting Rn=0 into the equation (1) yields an equation (2) below.

$$\{(1+\lambda)/\lambda\}Cn = Sn \quad (2)$$

The sun gear 12 therefore rotates $(1+\lambda)/\lambda$ times more than the carrier 13. The additional provision of the planetary gear mechanism 9 can increase the rotational phase caused by the rotation of the piston 8 by a factor of $\{(1+\lambda)/\lambda\}$.

This will be discussed in more detail with specific values substituted in the equation (2). Suppose that the phase difference (phase angle) of 10° has appeared between the cylinder 5 and the carrier 13 by the rotation of the piston 8, and that the ratio λ of the diameter of the sun gear 12 to that of the ring gear 11 is 0.5. Substituting these values into the equation (2) yields:

$$Sn = \{(1-0.5)/0.5\} \cdot 10 = 3 \cdot 10 = 30$$

The phase difference between the sun gear 12 and the ring gear 11 is 30° three times more than that (10°) of the cylinder 5 and the carrier 13. The preferable diameter ratio λ ranges from 0.3 to 0.6. A phase angle to be transmitted to the sun gear 12 is preferably about 2.6 to 4.4 times greater than a phase angle to be transmitted to the carrier 13.

As the phase angle becomes greater, the timing for closing the intake valve is significantly delayed in the region where both the engine load and the engine speed are low. The volume of the cylinder is therefore reduced in appearance so as to decrease the pumping loss. The "pumping loss" means an intake loss occurring when the engine takes in the necessary amount of air to impart its working power to the outside.

If the engine state shifts from the first region A or the second region B to the third region C, though not shown, the ECU 25 outputs a control signal to slightly open the control valve 22. As the control valve 22 is opened, the piston 8 moves to the position where the hydraulic pressure applied to the rear end of the piston 8 balances with the urging force of the return spring 24.

The amount of the displacement of the piston 8 and the amount of the rotation of the cam shaft 1 at this time are smaller than those in the case where the engine running state shifts to the second region B from the first region A. Naturally the timing for closing the intake valve is later than that in the case of the first region A, and earlier than that in the case of the second region B, making the amount of the valve overlapping smaller. Consequently, the intake inertia permits more amount of mixture to be fed into the cylinder. It is to be noted that the magnitude of the hydraulic pressure acting on the piston 8 at this time can be adjusted by altering the opening of the control valve 22.

As described above, according to this embodiment, the piston 8 and the planetary gear mechanism 9 intervene between the cylinder 5 having the timing pulley 6 and the cam shaft 1. The piston 8 and cylinder 5 are coupled together by means of the helical splines 8*a* and 3*a*, and the piston 8 and carrier 13 by means of the helical splines 8*b* and 15*a*. Further, the ring gear 11 is secured to the cylinder 5, and the sun gear 12 to the cam shaft 1. With this design, when the engine is in a steady state (no phase shifting made) which belongs to any of the first to third regions A to C, all the components of the valve timing controller rotate integrally. This embodiment can therefore prevent gearing noise from occurring and the individual gears from wearing out due to the backlash between the gears when no phase shift is made. When the engine running state shifts from one of the first to third regions A to C to another, the phase shifting mechanism 10 alters the rotational phase of the cam shaft 1 to the carrier 13. In addition, the phase angle can be amplified by the planetary gear mechanism 9, providing a large displacement angle for the cam shaft 1. The amount of the displacement angle can be set variably by changing properly the twisting angles of the helical splines 3*a*, 8*a*, 8*b* and 15*a* and/or the ratio of the diameter of the sun gear 12 to that of the ring gear 11.

This embodiment provides the following action and effect in addition to those described above.

For instance, in the case where the planetary gear mechanism 9 is eliminated and only the mechanism which moves the piston having helical splines in the axial direction to shift the rotational phase of the housing to the cam shaft is employed, the phase angle is determined by the amount of the axial movement of the piston. To increase the phase angle, therefore, the amount of the piston movement or the twisting angle of the helical splines should be increased, reducing the degree of design freedom. According to this embodiment, by way of contrast, the additional provision of the planetary gear mechanism 9 can not only easily increase the phase angle, but also it will give the rate of the increase in the phase angle by proper selection of the ratio of the diameter of the sun gear 12 to that of the ring gear 11. As a result, the degree of design freedom can be improved.

A second embodiment of the present invention will now be described referring to FIGS. 6 to 8.

This embodiment uses a step motor 35 as a means for moving the piston 8 forward and backward.

Figure 6:
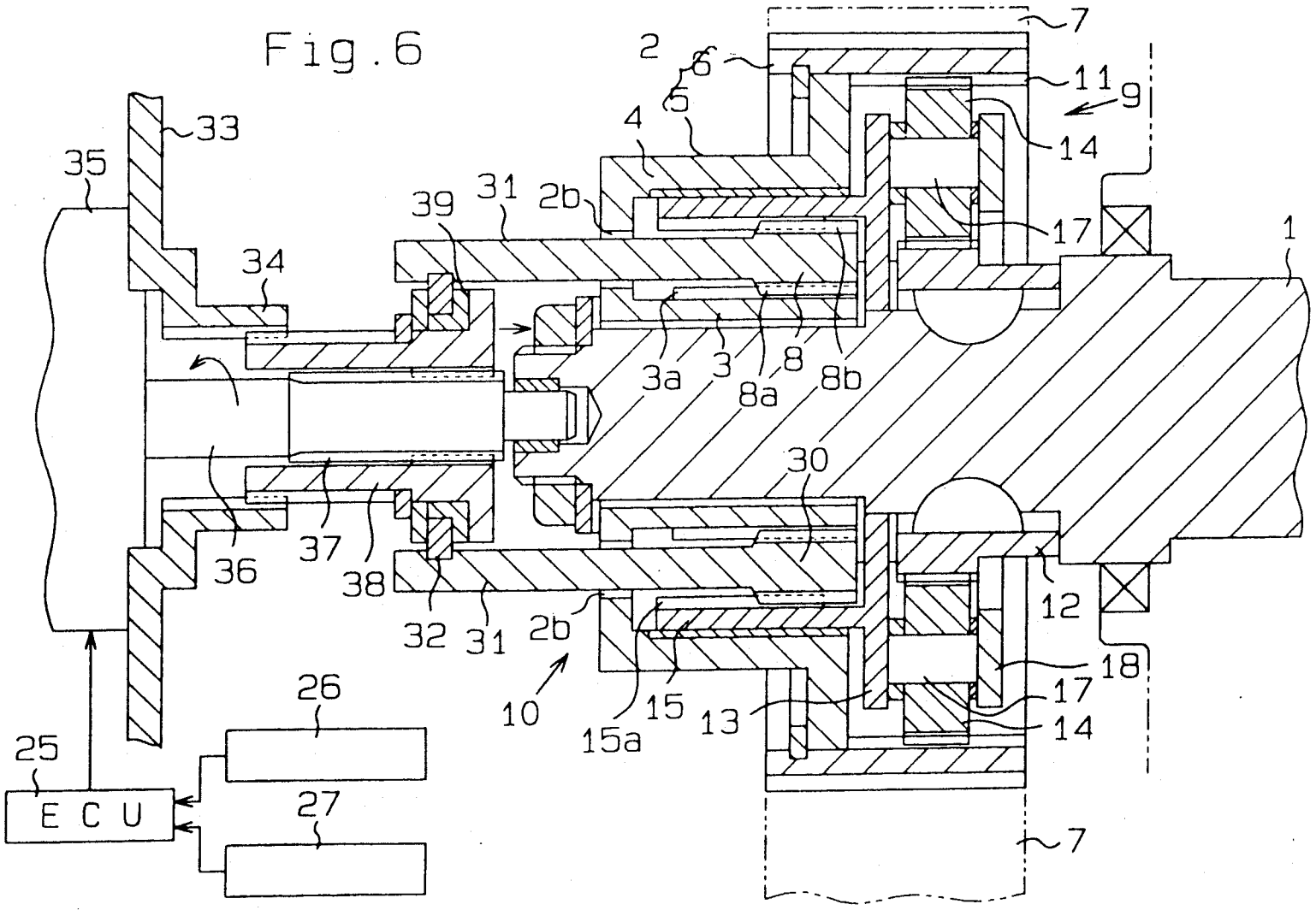
FIG. 6 is a cross section of a valve timing controller when a piston is moved backward by a step motor according to a second embodiment of the present invention.
Figure 7:
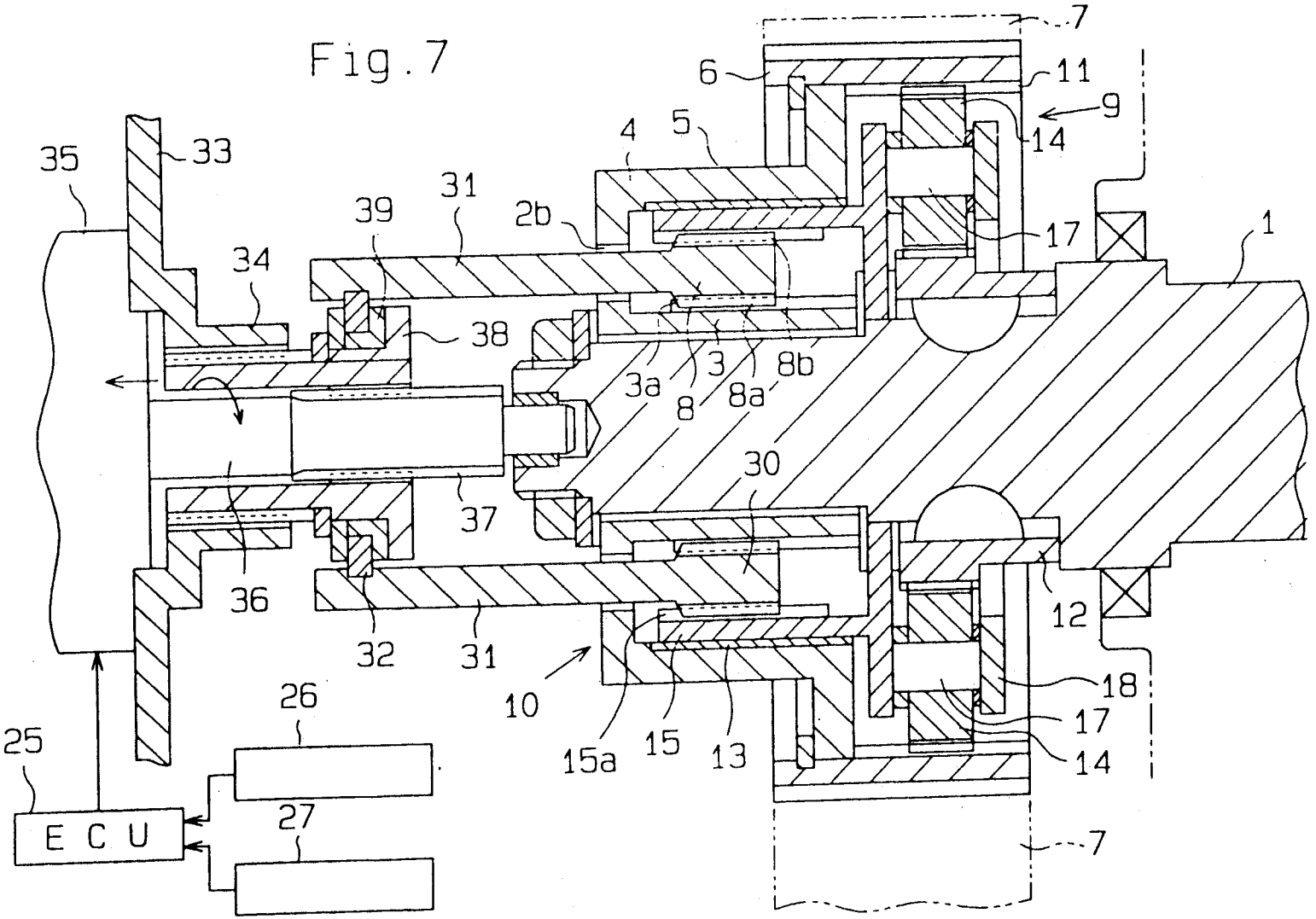
FIG. 7 is a cross section of the valve timing controller when the piston is moved forward by the step motor.

FIG. 6 illustrates the valve timing controller in an advanced angle state, and FIG. 7 illustrates it in a delayed angle state. As shown in both diagrams, a cylinder 5 with an open rear end is supported rotatable to the front end portion of a cam shaft 1. Between the cam shaft 1 and the cylinder 5 are disposed a phase shifting mechanism 10 for shifting the rotational phase of the cam shaft 1 to the cylinder 5, and a planetary gear mechanism 9 for amplifying the angle of the rotational phase.

Figure 8:
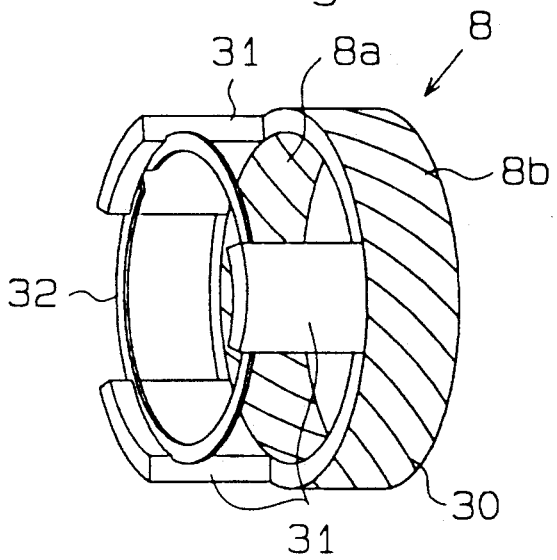
FIG. 8 is a perspective view of the piston.

As shown in FIG. 8, the piston 8 of the phase shifting mechanism 10 is provided with a ring-shaped body 30 having helical splines 8*a* and 8*b*. Three link pieces 31 protrude forward at equal angles from the front end of the body 30. These link pieces 31 penetrate through a hole 2*b* provided at the deepest portion of the cylinder 5. A coupling ring 32 is fixed to the front inner surfaces of the link pieces 31.

As shown in FIG. 6, a cylindrical portion 34 protrudes rearward on a timing belt cover 33 located at the front of the cam shaft 1. The step motor 35 is attached to the front of the cover 33. The motor 35 has a rotary shaft 36 penetrating the cylindrical portion 34 and rotatably supported on the front end portion of the cam shaft 1. The motor 35 rotates the rotary shaft 36 by an angle corresponding to the number of pulse signals output from an ECU 25. A feed screw 37 is formed on the outer surface of the rotary shaft 36, with a nut 38 fastened on the screw 37. The outer surface of the nut 38 and the inner surface of the cylindrical portion 34 are coupled by means of splines. As the rotary shaft 36 of the motor 35 rotates, the nut 38 is moved forward or backward.

A thrust bushing 39 is attached to the rear outer surface of the nut 38, and the coupling ring 32 is coupled rotatable to the thrust bushing 39.

The reason why the thrust bushing 39 is used here is to reduce the frictional resistance originated from the difference between the rotational speeds of the nut 38 and the coupling ring 32. The thrust bushing 39 may be replaced with a thrust bearing. The other structure of this embodiment is the same as that of the first embodiment.

According to this embodiment, when no phase shift is made as shown in FIGS. 6 and 7, the rotary shaft 36 of the motor 35 does not rotate based on the control signal from the ECU 25, and the components of the valve timing controller, such as the planetary gear mechanism 9 and phase shifting mechanism 10, rotate integrally. It is therefore possible to prevent the occurrence of gearing noise or the wear-out of the individual gears caused by the backlash between the gears.

When a phase shift is to be made, the rotary shaft 36 of the motor 35 rotates based on the control signal from the ECU 25, moving the nut 38 on the rotary shaft 36 forward or backward. As the piston 8 is coupled through the thrust bushing 39 to the nut 38, the piston 8 moves rotating with respect to the cylinder 5. Consequently, the rotational phase of the piston 8 to the cylinder 5 is shifted and its phase angle is increased by the planetary gear mechanism 9.

Further, the use of the step motor 35 in this embodiment also brings about the following effect.

In the case where hydraulic power and a return spring 24 are used as a means to move the piston 8, to attain continuous or multi-stage phase shifting, the piston 8 should be stopped where the hydraulic pressure acting on the piston 8 is balanced with the urging force of the return spring 24. The stop position of the piston 8 may be affected by the hydraulic pressure and the precision of the return spring 24. It is therefore necessary to apply the hydraulic pressure as designed to the piston 8 in the light of the fluid temperature, the hysteresis of the control valve 22, etc. To accomplish this, another sensor to detect the position of the piston 8 may be provided so that the hydraulic pressure, etc. can be controlled to position the piston 8 to a predetermined point.

When the piston 8 is moved to the determined position, it is in an unstable state balanced by the hydraulic pressure and the return spring 24. If the position of the piston 8 is unstable, the piston 8 may be deviated from the set position due to external factors, such as a change in torque caused by the rotation of the cam shaft 1. In this respect, it is desirable to provide another mechanism to hold the piston 8 in position.

According to this embodiment, on the contrary, the forward and backward positions of the piston 8 are determined by the rotational angle of the rotary shaft 36 of the step motor 35. This ensures the accurate positional control of the piston 8 without requiring a special sensor. Further, as the step motor 35 has self-holding torque, the piston 8 can be stably held at a predetermined position without requiring a special holding mechanism.

Furthermore, this embodiment does not utilize the hydraulic pressure to move the piston 8, thus eliminating the need to form a fluid path in the cam shaft 1 or cylinder 5.

Figure 9:
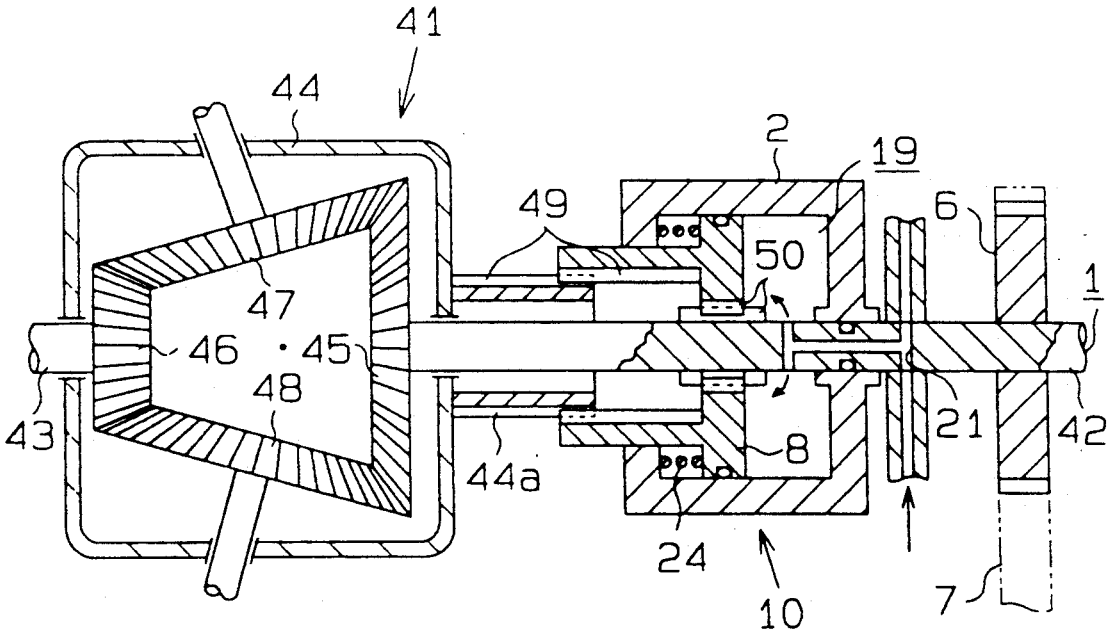
FIG. 9 is a cross section illustrating the schematic structure of a third embodiment of the present invention.
Figure 10:
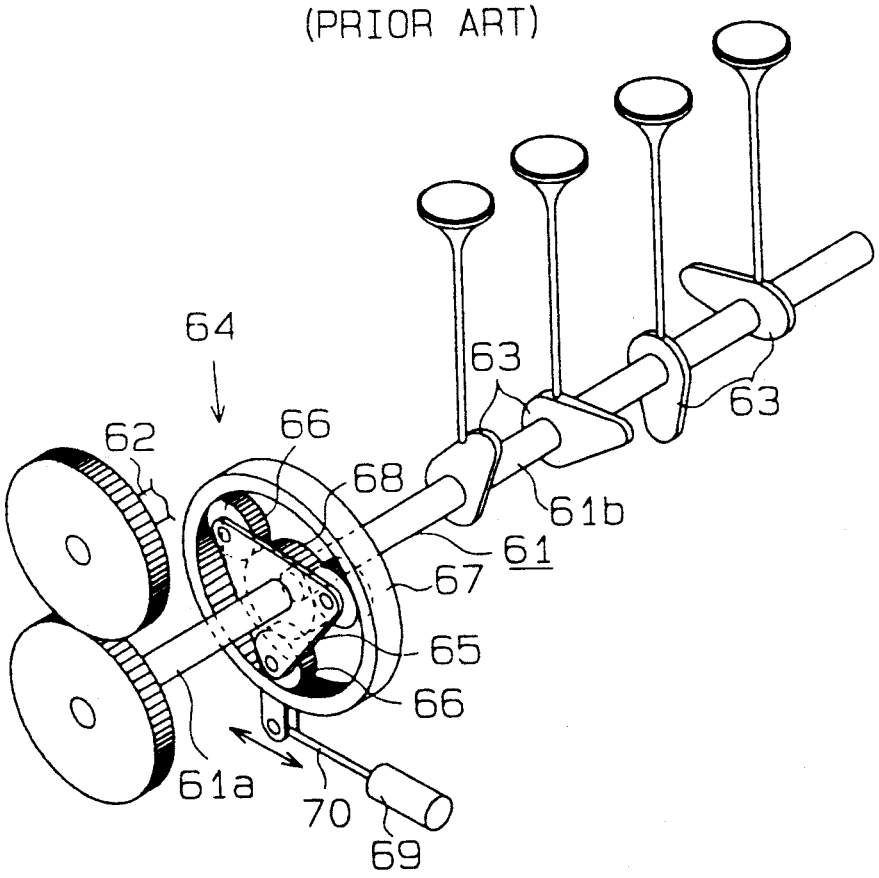
Fig. 10 (PRIOR ART)
FIG. 10 is a perspective view of a conventional phase shifting apparatus.

A third embodiment of this invention will now be explained referring to FIG. 9.

This embodiment differs from the first and second embodiments considerably in that the planetary gear mechanism 9 is replaced with a differential gear mechanism 41 as the accelerating gear mechanism. In FIG. 9 a timing belt 7 is located at the back (on the right-hand side in the diagram).

A cam shaft 1 is separated into an input-side shaft 42 and an output-side shaft 43, which are coupled together by the differential gear mechanism 41. The differential gear mechanism 41 includes a case 44, which covers end portions of both shafts 42 and 43 and has a cylindrical portion 44*a* provided at its rear end. In the case 44 are disposed input-side and output-side level gears 45 and 46 secured to the end portions of the shafts 42 and 43, and level gears 47 and 48 which supported rotatable by the case 44 and mesh with the former gears 45 and 46. The output-side level gear 46 is formed smaller than the input-side level gear 45.

A cylinder 5 is supported rotatable on the input-side shaft 42 between a timing pulley 6 and the differential gear mechanism 41. A cylindrical piston 8 is disposed in the cylinder 5. The piston 8 is coupled by means of helical splines 49 and 50 to a cylindrical portion 44*a* and the input-side shaft 42. In the shaft 42 is formed a fluid path 21 through which a working fluid is fed into the cylinder 5 with the delayed phase angle and is not supplied thereto with the advanced phase angle.

According to the valve timing controller constituted in the above manner, when no phase shift is made, the piston 8 neither moves forward nor backward, and the input-side shaft 42, piston 8, case 44, all the level gears 45 to 48, and output-side shaft 43 rotate integrally. Therefore, the rotational phase of the input-side shaft 42 to the output-side shaft 43 does not change.

When supplying a working fluid in the cylinder 5 starts or stops, the piston 8 moves forward or backward while rotating. Since the case 44 is coupled to the piston 8 by the helical spline 49, the case 44 rotates integrally with the piston 8. Consequently, the level gears 47 and 48 rotate both around the input-side level gear 45 and on their own axes. The rotation around the level gear 45 accelerates the rotation of the output-side level gear 46. The rotational phase therefore becomes larger by the differential gear mechanism 41, thus providing a large displacement angle of the output-side shaft 43.

This embodiment apparently has the same action and same effect as the first and second embodiments.

The present invention is not limited to the structures of the above-described embodiments, but may be modified in various other manners as desired within the scope and spirit of the invention.

(1) The timing pulley 6 in the individual embodiments may be replaced with a sprocket which is coupled in a drivable manner to the crank shaft by a chain.

(2) The valve timing controller of each described embodiment may be applied to an engine which has an intake cam shaft coupled in a drivable manner to an exhaust cam shaft by a scissors gear. In this case the valve timing controller should be disposed between the scissors gear and the cam shaft.

(3) One of the helical splines 8*a* and 8*b* on the inner and outer surfaces of the piston 8 may be changed to a spline.

(4) The same valve timing controller as used in each embodiment described above may be attached to the exhaust cam shaft.

What I claimed is:

1. An apparatus for shifting a phase between shafts in an internal combustion engine, comprising:

a drive shaft;

a driven shaft;

a phase shifting means for shifting a rotational phase of the driven shaft to the drive shaft between the drive shaft and driven shaft; and an amplifying gear means having a plurality of gears, for amplifying an amount of a phase shift when the phase shift is made by the phase shifting means and rotating all the gears integrally when no phase shift is made.

2. An apparatus according to claim 1, further comprising first and second power transmitting means for transmitting power from the drive shaft to the driven shaft.

3. An apparatus according to claim 2, wherein the first power transmitting means includes a pulley fixed on one of the drive shaft and the driven shaft, with a belt for transmitting the rotation of the drive shaft to the driven shaft being put around the pulley.

4. An apparatus according to claim 3, wherein the first power transmitting means further includes:

a first gear secured on the one of the drive shaft and driven shaft;

a second gear provided on an inner surface of the pulley; and a third gear, disposed between the first and second gears, for engaging with the first and second gears.

5. An apparatus according to claim 4, wherein the second power transmitting means includes a support member for supporting the third gear and a coupling member for coupling the support member to the pulley, the coupling member being coupled by means of a spline to the support member and the pulley so as to be movable only in an axial direction.

6. An apparatus according to claim 5, wherein the phase shifting means is constituted by coupling the coupling member to at least one of the support member and the pulley by a helical spline.

7. An apparatus according to claim 6, wherein the coupling member is moved by a hydraulic pressure corresponding to a running state of the engine.

8. An apparatus according to claim 6, wherein the coupling member is moved by an electric motor to be driven in accordance with a running state of the engine.

9. An apparatus according to claim 4, wherein the amplifying gear means comprises the first gear and the third gear and amplifies an amount of a phase shift in accordance with a ratio of the diameter of the first gear to that of the third gear.

10. An apparatus according to claim 4, wherein the amplifying gear means comprises four level gears arranged in a rectangular ring, those of the level gears on an output side having a smaller diameter than those on an input side.

11. An apparatus for shifting a phase between shafts in an internal combustion engine, comprising:

a drive shaft;

a driven shaft;

a power transmitting means for transmitting power from the drive shaft to the driven shaft;

a phase shifting means for shifting a rotational phase of the driven shaft to the drive shaft between the drive shaft and driven shaft; and an amplifying gear means having a plurality of gears, for amplifying an amount of phase shifting when the phase shift is made by the phase shifting means and rotating all the gears integrally when no phase shift is made.

12. An apparatus according to claim 11, wherein the power transmitting means includes:

a pulley fixed on one of the drive shaft and the driven shaft, with a belt for transmitting the rotation of the drive shaft to the driven shaft being put around the pulley;

a first gear secured on the one of the drive shaft and driven shaft;

a second gear provided on an inner surface of the pulley; and a third gear, disposed between the first and second gears, for engaging with the first and second gears.

13. An apparatus according to claim 12, wherein the power transmitting means further includes a support member for supporting the third gear and a coupling member for coupling the support member to the pulley, the coupling member being coupled by means of a spline to the support member and the pulley so as to be movable only in an axial direction.

14. An apparatus according to claim 13, wherein the phase shifting means is constituted by coupling the coupling member to at least one of the support member and the pulley by a helical spline.

15. An apparatus according to claim 14, wherein the coupling member is moved by a hydraulic pressure corresponding to a running state of the engine.

16. An apparatus according to claim 15, wherein the coupling member is moved by an electric motor to be driven in accordance with a running state of the engine.

17. An apparatus according to claim 12, wherein the amplifying gear means comprises the first gear and the third gear and amplifies an amount of phase shifting in accordance with a ratio of the diameter of the first gear to that of the third gear.

18. An apparatus according to claim 12, wherein the amplifying gear means comprises four level gears arranged in a rectangular ring, those of the level gears on an output side having a smaller diameter than those on an input side.

19. An apparatus for shifting a phase between shafts in an internal combustion engine, comprising:

a drive shaft;

a driven shaft;

a pulley fixed on one of the drive shaft and the driven shaft, with a belt for transmitting the rotation of the drive shaft to the driven shaft being put around the pulley;

a first gear secured on the one of the drive shaft and driven shaft;

a second gear provided on an inner surface of the pulley;

a third gear, disposed between the first and second gears, for engaging with the first and second gears;

a support member for supporting the third gear; and a coupling member for coupling the support member to the pulley, the coupling member being coupled by means of a spline to the support member and the pulley so as to be movable only in an axial direction, and being coupled by a helical spline to at least one of the support member and the pulley, an amount of phase shifting being amplified in accordance with a ratio of the diameter of the first gear to that of the third gear.

* * * * *